US005369384A

United States Patent [19]

Heins

[11] Patent Number: 5,369,384

[45] Date of Patent: Nov. 29, 1994

[54] POWER CIRCUIT BREAKER WITH A BREAKER MECHANISM AND A BREAKER MECHANISM FOR A POWER CIRCUIT BREAKER

[75] Inventor: Volker Heins, Meckenheim, Germany

[73] Assignee: Klockner-Moeller GmbH, Bonn, Germany

[21] Appl. No.: 107,249

[22] Filed: Aug. 16, 1993

[30] Foreign Application Priority Data

Aug. 17, 1992 [DE] Germany ..... 4227213

[51] Int. Cl.[5] ..... H01H 9/20

[52] U.S. Cl. ..... 335/171; 335/172; 335/8

[58] Field of Search ..... 335/8–10, 335/21–23, 167–176

[56] References Cited

U.S. PATENT DOCUMENTS 3,005,066 10/1961 Powell .
3,147,352 9/1964 Giessner et al. .
3,152,232 10/1964 Leonard .
4,151,495 4/1979 Rys et al. .
4,736,174 4/1988 Castonguay et al. .
4,835,842 6/1989 Castonguay et al. ..... 335/167
4,888,570 12/1989 Toda ..... 335/172
5,200,725 4/1993 Arnold et al. ..... 335/21

FOREIGN PATENT DOCUMENTS 3812950 11/1988 Germany .
3802184 8/1989 Germany .

*Primary Examiner*—Lincoln Donovan
*Attorney, Agent, or Firm*—Nils H. Ljungman & Associates

[57] ABSTRACT

The breaker mechanism for power circuit breakers is the energy storage link between the handle and the contact systems. Known breaker mechanisms are generally too expensive to manufacture. When contact welding occurs, there is also the risk that, in spite of the tripping of the breaker mechanism, the contact system will not open. The new breaker mechanism reliably opens the contact system and consists of fewer and technologically simpler individual parts. It is inserted between two symmetrical breaker plates held in a die cast housing, and in which a connecting piece is mounted. Two toggle levers are connected at a distance from one another by means of a connecting shaft engaged in crossbar cam slots. A toggle lever spring is engaged between the connecting piece and the connecting shaft. A bracing lever which can be driven by the connecting piece is friction locked in the breaker plates, and the toggle levers in the bracing lever. A latch lever and a latch holding the latter in the locked position are friction locked by means of a latch spring in recesses of the breaker plates.

18 Claims, 5 Drawing Sheets

POWER CIRCUIT BREAKER WITH A BREAKER MECHANISM AND A BREAKER MECHANISM FOR A POWER CIRCUIT BREAKER

BACKGROUND OF THE INVENTION

1. Field of the Invention

The invention generally relates to a breaker mechanism for a power circuit breaker in a die cast housing, the circuit breaker being connected with a crossbar supporting contact arms. The breaker mechanism contains a connecting element, a bracing lever which can be driven with the connecting element two toggle levers connected on their terminal ends, an energy storage mechanism engaged between the connecting element and the ends of the toggle levers, a latch which can be activated by trips, and a latch lever which can be latched by the latch and which, for its part, locks the bracing lever in the untripped position.

2. Background Information

Generally, a breaker mechanism, as a mechanical link equipped with an energy storage mechanism between the manual activation mechanism or the mechanical drive and the contact system, is used for closing and opening, as well as automatic tripping when overcurrents occur.

A known breaker mechanism is disclosed in German Laid Open Patent Application No. 38 12 950 and mounted in a die-cast, or molded, housing of the power circuit breaker and contains a connecting element which can be activated by means of a grip handle. The grip handle is mounted so that it can pivot in a U-shaped frame. The breaker mechanism also contains a bracing lever linked by means of a fastening block to the frame, as well as toggle levers connected to the bracing lever on both sides, with a roller on their ends. The roller is used to pivot, by means of crossbar cam slots, a crossbar supporting a contact arm and simultaneously to engage two toggle lever springs which are under tension and which are fastened to the switch connecting element and act as energy storage mechanisms. On the open side of the support frame, there is a side frame, in which a latch lever and a latch are mounted so that they can pivot, along with a leaf-shaped latch spring. In the closed and open positions, the bracing lever is locked by means of a hook through the latch lever, which for its part is latched by means of correspondingly configured latching surfaces by the latch. If, by means of a thermal or a magnetic overcurrent trip, the latch is caused to pivot, then the latching surfaces are released. Under the action of the force exerted by the toggle lever springs, the latch, the bracing lever which is thereby unlocked, the toggle levers and the connecting elements are rocked into the tripped position, i.e. opening the contacts. After the cause of the trip has been eliminated, the breaker mechanism can be relatched or relocked and closed, via the open position.

One disadvantage of the known solution described above is that it costs too much to manufacture. It is expensive in particular because of the requirement for the side frame and the fastening block which, like the latch, must generally be manufactured in a complex, time-consuming and expensive manner as die cast parts. It also requires a great many mounting means, such as: rivets for the connection between the bracing lever and the toggle; pivots for the bracing lever, the side frames and the latch; as well as an alignment pin and guide hole for the fastening block. Because of the use of the complex actuator roller, specially designed latch springs and two toggle springs are also required. An additional significant disadvantage is that if the contacts weld shut, the contact apparatus may not open in spite of the tripping of the breaker mechanism.

OBJECT OF THE INVENTION

The object of the invention is therefore to create a breaker mechanism which will reliably open the contact apparatus, and which consists of a few, technologically simple parts.

SUMMARY OF THE INVENTION

The invention essentially teaches that this object can be achieved by a contact system wherein: the breaker mechanism can be inserted between two symmetrical breaker plates mounted in the die cast housing; the toggle levers are symmetrical to one another and are connected at a distance by means of a connecting shaft which is engaged in cam slots of the crossbar; the energy storage mechanism consists of only one toggle lever spring, one end of which is engaged with the connecting shaft; the toggle levers are supported so that they can pivot against the force of the toggle lever spring in the side walls of the bracing lever; the bracing lever is braced so that it can pivot against the force of the toggle lever spring in the breaker plates; the latch and the latch lever can be inserted so that they pivot in the breaker plates, and are mounted in the breaker plates by the force of a latch spring engaged with the latch and the latch lever.

The proposed breaker mechanism essentially consists of fewer elements than the prior art, but most of these elements perform several functions. These elements can be mounted in a technologically advantageous manner to execute simple movements into one another and between the breaker plates, whereby they are essentially held by a friction fit in a lateral direction between the breaker plates and under the action of the toggle lever springs and the latch springs. The breaker mechanism can be assembled without using complex connection methods such as welding or riveting.

Additional advantageous configurations of the contact system according to the invention are disclosed herebelow. Pivot pins, disposed on the breaker plates, and wrap-arounds on the bracing lever, as well as first and second end surfaces and stop surfaces of the toggle lever and of the bracing lever, and toggle lever and bracing lever abutments, are particularly advantageous means to join the relative elements of the breaker mechanism to one another and to hold them in positions so that they can pivot in relation to one another under the action of the toggle lever springs. The connecting elements, the bracing lever, the toggle lever and the toggle lever spring form a simple rocker mechanism, but one that advantageously can be moved very rapidly into the tripped position. The movement into the tripped position can be restricted simply and effectively by means of corner stops on the breaker plates and extensions on the bracing lever. When the contact tips are welded together, the third end surfaces and stop surfaces on the toggle levers and on the connecting elements respectively create leverage during the opening which breaks these contacts. The same effect is achieved during the transition into the tripped position by the interaction between the fourth end surface and the third stop surface. Keys on the bracing lever make possible a simple and effective lateral guidance of the toggle lever in the bracing lever, whereby a limit stop represents an additional means to protect the position of the toggle lever against the strong forces which occur during breaker mechanism movements when the contacts are initially welded.

A coil-shaped latch spring represents a particularly economical standard part. Thus, the latch and the toggle lever can be friction-locked together by means of the latch and latch lever support moldings in the corresponding latch and latch lever support recesses, in which they were previously inserted in a simple manner. An essentially triangular configuration of these recesses and of the latch support moldings represent a particularly simple means to achieve this advantage. To facilitate assembly, there are preferably a latch hole and a latch lever hole, or in a particularly advantageous manner, instead of holes, hook-shaped configurations on the latch and latch lever. The latch lever key on the latch lever and the corresponding bearing surfaces on the latch tend to produce a more rapid latching of the latch lever, and thereby tend to significantly facilitate the mechanization of the breaker mechanism, if desired, by means of a motor.

BRIEF DESCRIPTION OF THE DRAWINGS

The invention is explained in greater detail below, with reference to the embodiment illustrated in the accompanying drawings, wherein.

DESCRIPTION OF THE PREFERRED EMBODIMENT

Figure 1:
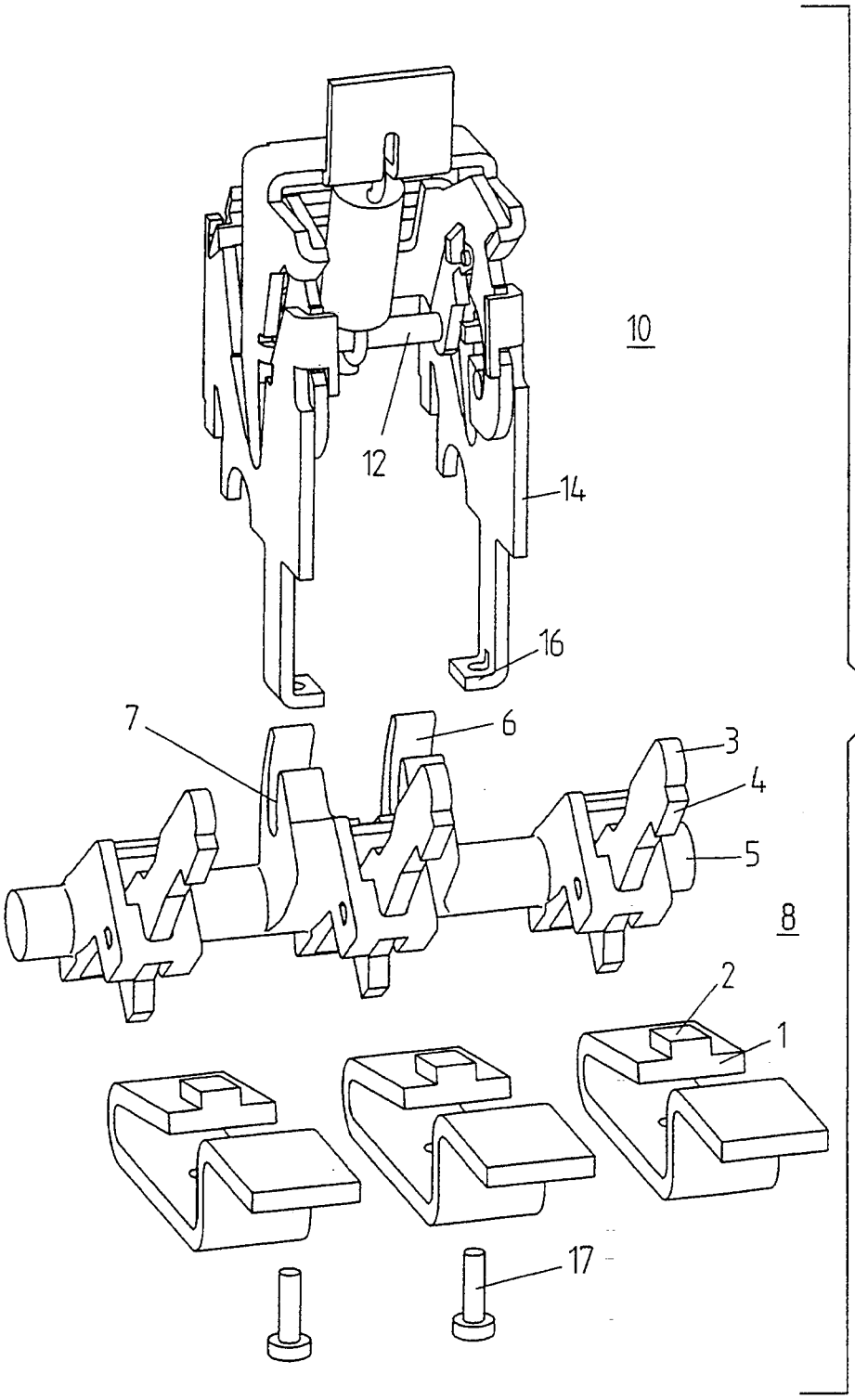
FIG. 1 shows a breaker mechanism according to the invention with a corresponding contact system, in a partly exploded view.

FIG. 1 shows a breaker mechanism 10 according to the present invention as part of a power circuit breaker, and a contact system activated by the breaker mechanism with three contact systems 8. Each contact system 8 may preferably contain a stationary contact carrier 1 with a welded-on stationary contact tip 2 as well as a moving contact arm 3 with a welded-on moving contact tip 4. The contact arms 3 are preferably flexibly mounted in a crossbar 5, on which two cams 6 may preferably be molded radially. Cam slots 7 are preferably used to hold a connecting shaft 12 of the breaker mechanism 10 and thus to transmit motion from the breaker mechanism 10 to the contact system. The contact carriers 1 and the crossbar 5 are preferably embedded or mounted in a conventional manner in a die-cast housing (not shown). The breaker mechanism 10 preferably has two lateral, symmetrical breaker plates 14. The position of these plates is preferably fixed by internal lateral surfaces of the die-cast housing and by L-shaped fastening extensions 16 on the ends, which can preferably be bolted to the base of the die-cast housing by means of two fastening screws 17 screwed into the die-cast housing from the bottom.

Thus, in accordance with a preferred embodiment of the present invention, crossbar 5 preferably includes three contact arms 3.

Figure 2:
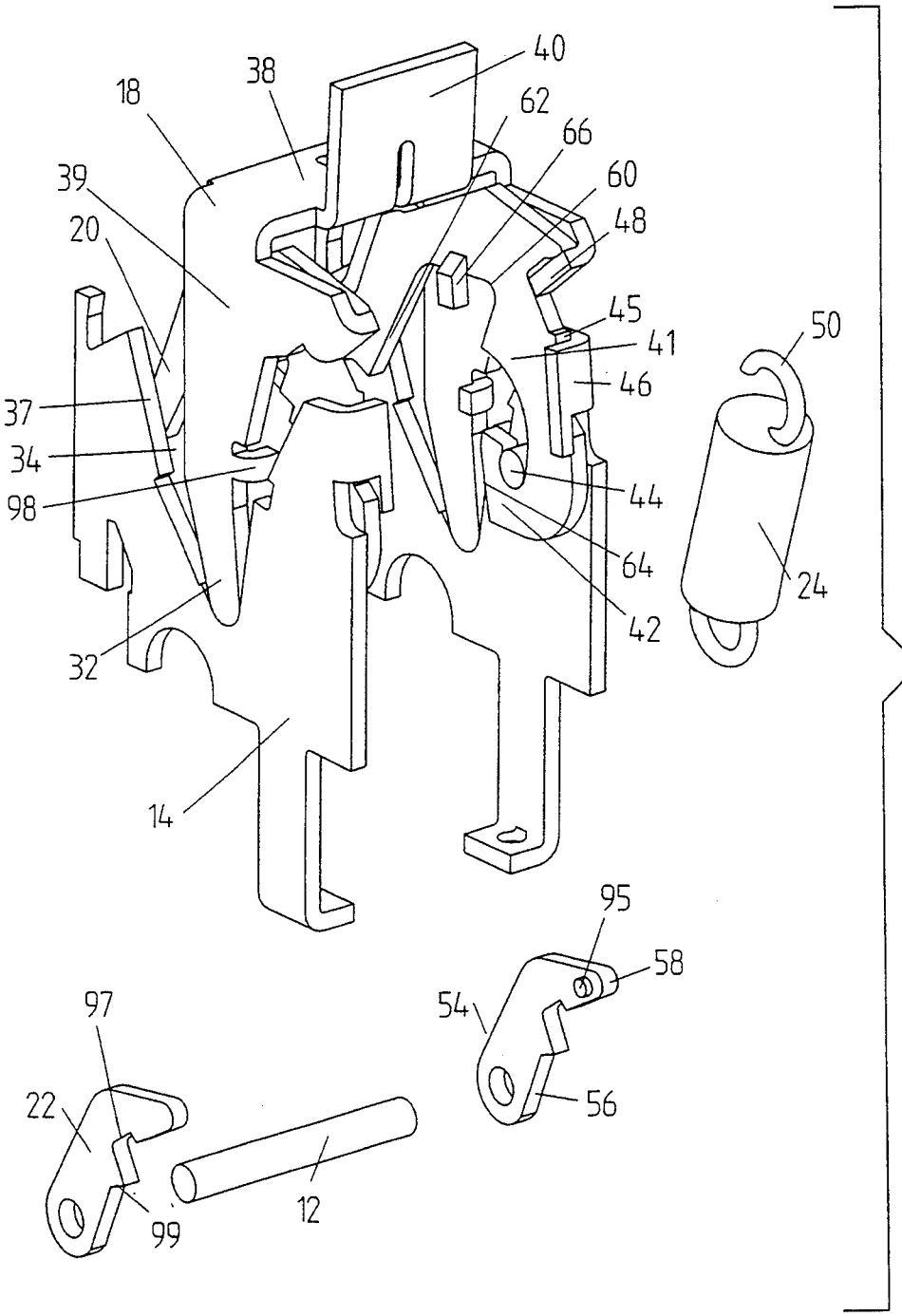
FIG. 2 shows a portion of the breaker mechanism in a partly exploded view, seen in frontal perspective.
Figure 3:
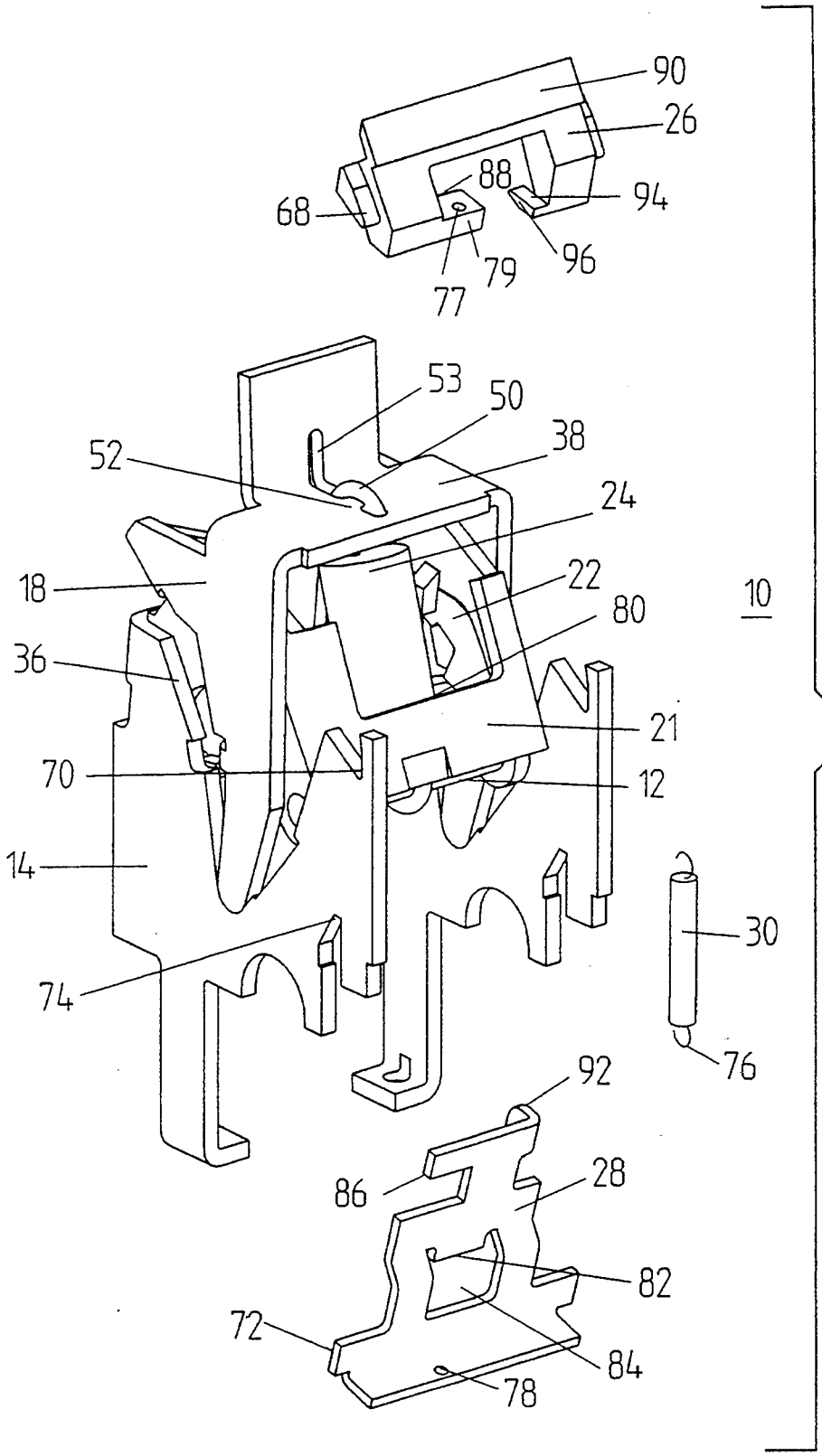
FIG. 3 shows an additional exploded view of the breaker mechanism, seen in rear perspective.

As shown in FIGS. 2 and 3, the breaker mechanism preferably includes two breaker plates 14, a connecting element 18, a bracing lever 20, two toggle levers 22, the connecting shaft 12, a coil-shaped toggle lever spring 24, a latch 26, a latch lever 28 and a latch spring 30. The interconnection and functional cooperation of these components is discussed in more detail herebelow.

The connecting element 18 can preferably be essentially U-shaped and has a connecting web 38 with a bent flange 40 for fastening a handle (not shown), as well as two lateral arms 39. By means of the ends 32 of the arms, the connecting element 18 is preferably mounted from above in support recesses 34 of the breaker plates 14 so that it can pivot, whereby the pivoting movement can preferably be restricted by front and rear end limit surfaces 36 and 37, respectively, of the support recesses 34. Preferably, bracing lever 20 is U-shaped and is flexibly supported above against the force of the toggle lever spring 24 by means of two wrap-arounds 42 on its side walls 41 against two pivot pins 44 which are located on the inside of each breaker plate 14. The side walls 41 of the bracing lever 20 are preferably formed in such a way that, in the tripped position, the pivoting movement of bracing lever 20 is restricted by its extensions 45 and by corner stops 46 bent inward on the breaker plates 14. Also, bracing lever 20 can preferably be moved from the tripped to the open position by inwardly-bent drive corners 48 on the arms 39 of the connecting piece 18.

Thus, in accordance with a preferred embodiment of the present invention, each breaker plate 14 preferably includes a pivot pin 44 disposed on an inwardly-facing surface of the breaker plate. Bracing lever 20 preferably has two wrap-around extensions 42, each one disposed adjacent breaker plate 14. Preferably, each wrap-around extension 42 is preferably embodied by a generally downward extension of bracing lever 20 which is configured to wrap around a major portion of the circumference of the corresponding pivot pin 44. Thus, for example, each wrap-around extension 42 may preferably describe an internal wrap-around angle of about 180° to about 270°.

The two-armed toggle levers 22 are preferably identical with respect to one another. They are each preferably connected on one end and held at a distance from one another by the connecting shaft 12. The toggle lever spring 24 is preferably engaged by means of a ring 50 each in the center of the connecting shaft 12 and on a web 52 inside a fastening slot 53 in the web 38 of the connecting piece 18. The toggle levers 22 are preferably supported against the force of the toggle lever springs 24 in the bracing lever 20. For that purpose, each of the toggle levers 22 preferably has a first end surface 54 for the open position, and a second end surface 56 for the closed position. Between the two end surfaces 54 and 56 there is preferably a curved toggle lever abutment 58. The toggle lever abutments 58 are preferably supported in wider open curved bracing lever abutments 60 which are formed in open recesses of the side walls 41 of the bracing lever 20, and are preferably adjacent to a first stop surface 62 corresponding to the first end surface 54 and a second stop surface 64 corresponding to the second end surface 56. The connecting piece 18, the bracing lever 20, the toggle lever 22 and the toggle lever spring 24 thus essentially form a simple but very effective rocker mechanism. The rocking angle of the toggle levers 22 is determined by the amount by which the inside angle between the first and second stop surfaces 62 and 64 is greater than the outside angle between the first and second end surfaces 54 and 56. In the overextended position of the rocker mechanism i.e. at the maximum extension of the toggle lever spring 24 in an intermediate position between the open and closed position of the breaker mechanism 10, the points of contact of the toggle lever abutments 58 with the bracing lever abutments 60 are preferably essentially in a plane with the contact points of the toggle lever springs 24 against the connecting element 18 or on the connecting shaft 12. The toggle levers 22 held at a distance by the connecting shaft 12 are each preferably guided laterally by a guide lug 66 die cast on the side walls 41 of the bracing lever 20.

Thus, in accordance with a preferred embodiment of the present invention, each toggle lever 22 is preferably mounted so as to pivot between stop surfaces 62 and 64 of bracing lever 20. Further, external planar surfaces of each toggle lever 22 are preferably configured to be flush with external planar surfaces defined by side walls 41 of bracing lever 20, such that each toggle lever 22 essentially undergoes pivotal movement within the confines of planar surfaces defined by side walls 41 of bracing lever 20. Additionally, in a manner which will be more readily understood further below with reference to FIGS. 4 through 7, it will be appreciated that toggle lever spring 24 preferably extends between connecting shaft 12 and connecting piece 18 in such a way that, when toggle lever spring 24 is maximally extended during movement of connecting piece 18 between an open and a closed position, the points of contact of the toggle lever abutments 58 with the bracing lever abutments 60 are coplanar with either or both of the contact points of the toggle lever spring 24 with the connecting piece 18 or the connecting shaft 12.

On the sides, the latch 26 preferably has triangularly-shaped prismatic latch support moldings 68, by means of which moldings the latch 26 can be mounted from above so that it can pivot in triangularly-shaped latch support recesses 70 which are located in the breaker plates 14 on the side facing away from the contact systems 8 (See FIG. 1). On the sides, the latch lever 28 preferably has lateral latch lever support moldings 72, by means of which it is mounted from below so that it can pivot in triangularly shaped latch lever support moldings 74, which are located in the breaker plates 14 below the latch support recesses 70. A coil-shaped latch spring 30 is preferably suspended by means of rings 76 under slight tension in a corresponding hole 77 in latch 26 and a corresponding hole 78 in latch lever 28, by means of which spring the latch 26 and the latch lever 28 are mounted in the breaker plates 14. The latch hole 77 can preferably be located in a key-like first projection 79 of the latch 26 underneath the latch support recesses 68.

Thus, in accordance with a preferred embodiment of the present invention, latch 26 and latch lever 28 are each preferably pivotably mounted between breaker plates 14 and preferably extend perpendicularly with respect to breaker plates 14. As shown, latch 26 preferably has a pair of downwardly-oriented prismatic moldings 68 which can each be accommodated in triangular recesses 70 in a rear portion of each breaker plate 14. Similarly, latch lever 28 preferably has a pair of lateral extensions 72 which can each be accommodated in triangular support moldings 74 in a rear portion of each breaker plate 14. Thus, a recess 70 is preferably provided vertically above the support molding 74 in the rear portion of each breaker plate 14 such that latch 26 will be positioned generally above latch lever 28. Latch 26 and latch lever 28 are preferably held together by latch spring 30.

An upward-pointing first locking surface 80 in a rectangular, open recess on the rear side 21 of the bracing lever 20, preferably interacts with a downward-pointing, second locking surface 82 in a rectangular, enclosed recess 84 of the latch lever 28 when the breaker mechanism 10 is either in an open or a closed position. On the latch lever 28, above the recess 84 in an open rectangular jog, there is preferably a downward-pointing, first latching surface 86, which, when breaker mechanism 10 is in either of the open and closed positions, preferably interacts with a second latching surface 88 which is formed on the first projection 79 of the latch 26. The first latching surface 86 and the second latching surface 88 preferably achieve a positive latching between the latch 26 and the latch lever 28 whereby, under the force of the toggle lever spring 24, the lock between the latch lever 28 and the bracing lever 20 is maintained, so that the latching mechanism 10 remains under tension.

The latch 26, above the latch support moldings 68, preferably has a trip surface 90, which is preferably configured to absorb the tripping movement of a magnetic or thermal trip (not shown). From the upper part of latch lever 28, oriented toward the latch 26, there is preferably an angled latch lever key 92 which, during a transition from a tripped position to a locked position, interacts with a bearing surface 94 which points upward and is formed on a second projection 96 of the latch 26, whereupon rapid locking and latching is facilitated by a rather strong prestress from the latch spring 30.

Figure 4:
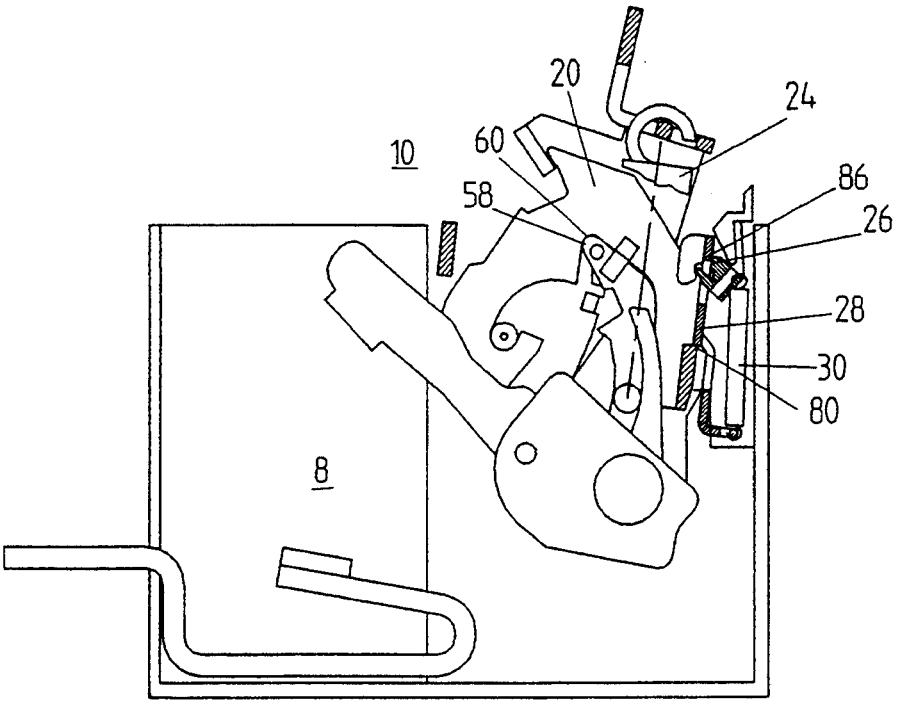
FIG. 4 shows a side view of the breaker mechanism with the corresponding contact system, in the open position.

When the breaker mechanism 10 is in the open position as in FIG. 4, i.e. when the contact systems 8 are opened, the toggle lever abutments 58 and the bracing lever abutments 60 are preferably to the left of the line connecting the contact points of the toggle lever springs 24. As described further above, the bracing lever 20 is preferably locked by means of the first locking surface 80 by the latch lever 28 which, for its part, is preferably latched by means of the first latching surface 86 by the latch 26 and the latch spring 30, and is thus held in the locking position.

Figure 5:
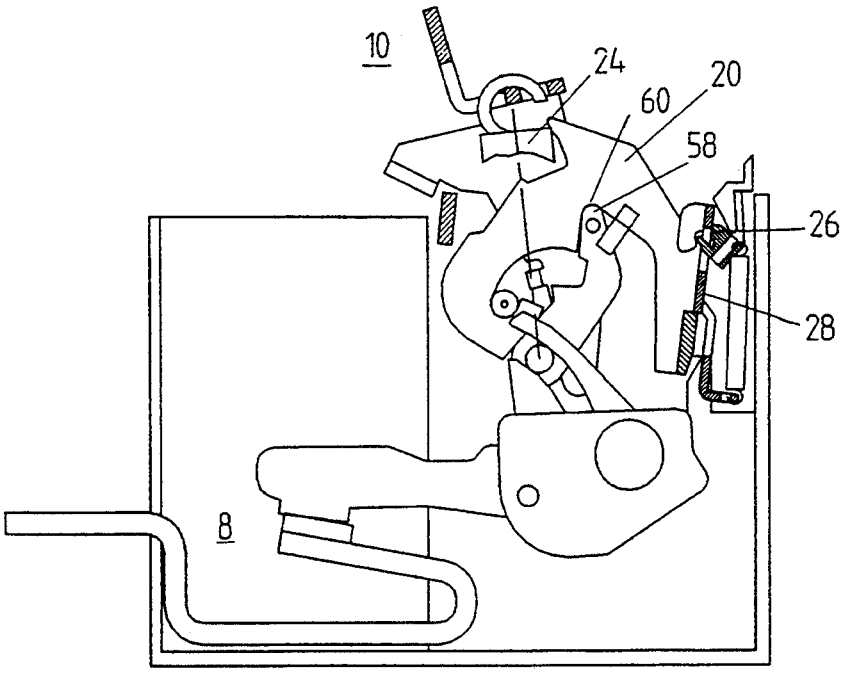
FIG. 5 is a view as in FIG. 4, but in the closed position.

When the breaker mechanism 10 is in the closed position as shown in FIG. 5, i.e. when the contact systems 8 are closed, the toggle lever abutments 58 and the bracing lever abutments 60 are preferably to the right of the line connecting the contact points of the toggle lever springs 24. However, it will be appreciated that the bracing lever 20, the latch lever 28 and the latch 26 will be in essentially the same positions as in the open position shown in FIG. 4. It will also be understood that, in order to switch the breaker mechanism 10 from the open position to the closed position, flange 40 of connecting element 18 (See FIG. 2) essentially should be pulled forward by means of a handle or other appropriate means.

Figure 6:
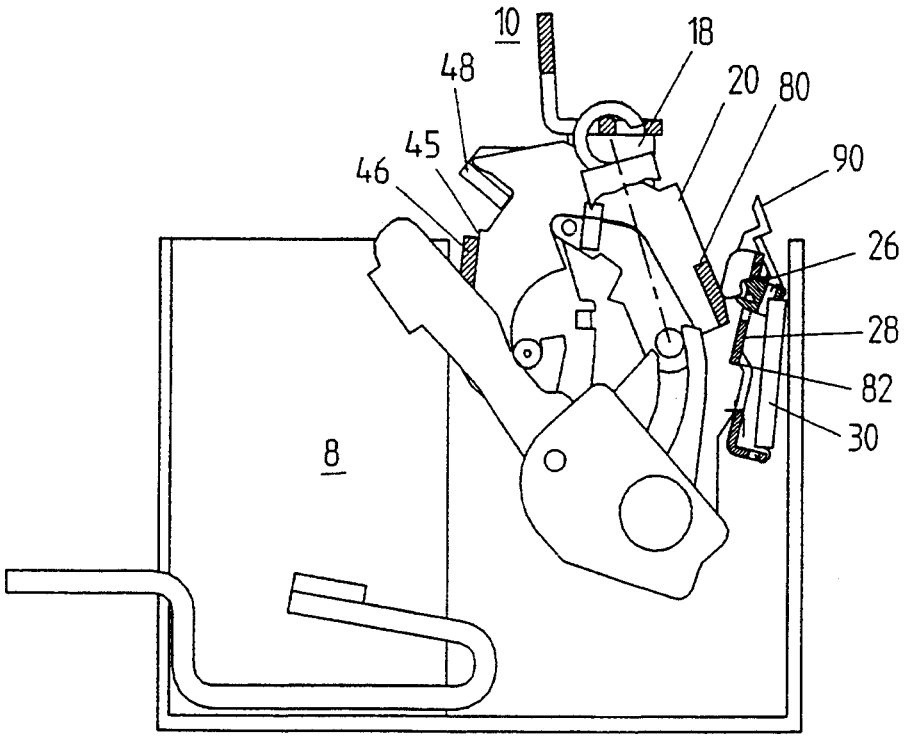
FIG. 6 is a view as in FIG. 4, but in the tripped position.

FIG. 6 shows the tripped position of the breaker mechanism 10, in which the contact systems 8 normally move into the open position. The tripped position has essentially been achieved by the force acting on the trip surface 90 of the latch 26, which force will have been generated by a trip in the event of an overcurrent. The latch 26 and the latch lever 28 have thereby been unlatched from one another, which then, on account of the release of the locking surface 80 of the bracing lever 20, results in a sudden release of the breaker mechanism 10. FIG. 6 shows the movement restriction described above of the bracing lever 20 in the counterclockwise direction by the interaction of the extensions 45 of the bracing lever 20 with the corner stops 46 of the breaker plates 14 (See FIG. 2).

If, after the disappearance or elimination of the tripping event, the connecting piece 18 is pivoted in the clockwise direction into the open position, then, by means of drive corner 48, the bracing lever 20 is pivoted in the same direction. The latch lever key 92 thence slides along the rear side 21 of the bracing lever 20 (See FIG. 3). As a result of the pivoting motion of the latch lever 28 also produced in the clockwise direction, the first locking surface 80 on the bracing lever 20 again comes under the second locking surface 82 on the latch lever 28, which in turn is latched by the latch 26.

Thus, in accordance with a preferred embodiment of the present invention, when a tripping stimulus acts on trip surface 90 of latch 26 to trip the breaker mechanism 10, the bracing lever 20 essentially is released and pivots forward. With reference to FIG. 6, forward, or counterclockwise, movement of the bracing lever is limited by corner stops 46 of breaker plates 14, which contact extensions 45 of bracing lever 20 to stop bracing lever 20. If, after the disappearance or elimination of the tripping event, it is desired that the breaker mechanism 10 once again be moved into another position, such as an "open" position, connecting piece 18 may preferably be pivoted rearwardly, or clockwise. In so doing, drive corner 48 of connecting piece 18 will preferably displace bracing lever 20 rearwardly, and latch lever 28 will once again become latched by latch 20.

Figure 7:
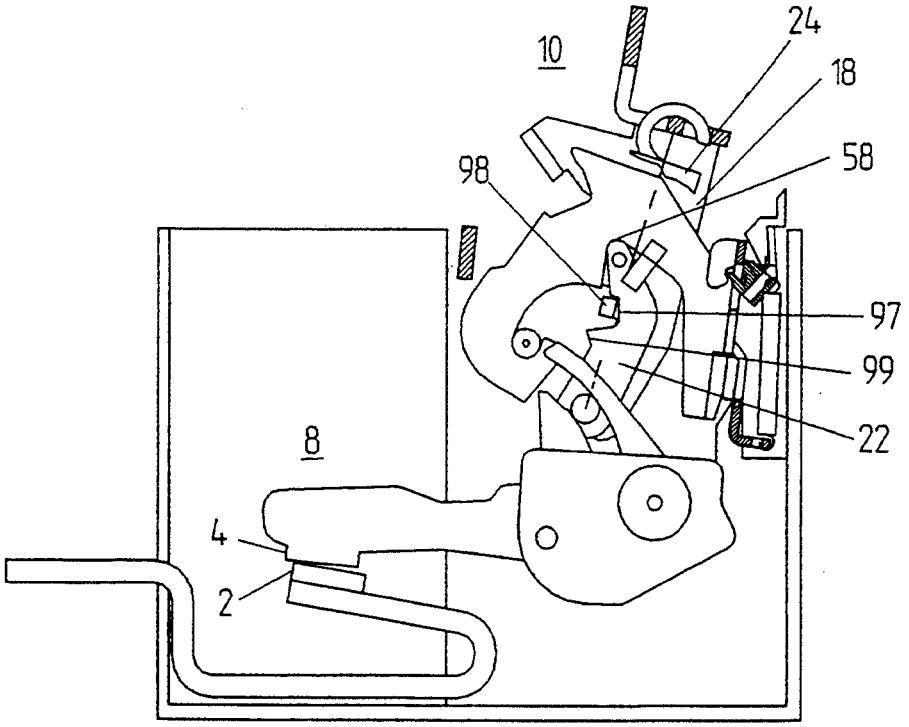
FIG. 7 is a view as in FIG. 4, but with welded contacts.

FIG. 2 also shows that on the arms 39 of the connecting piece 18, there is also a third stop surface 98 formed at an angle, which corresponds to a notched third end surface 97 on each of the toggle levers 22. This third end surface 97 is on the same side as the second end surface 56, but is slightly closer to the toggle lever abutment 58. As shown in FIG. 7, during opening by means of the connecting piece 18, the third stop surface 98 and the third end surface 97 come into contact with one another if the contact tips 2 and 4 are welded together, whereupon, after exceeding the overextended, or maximally extended, position of the toggle lever spring 24, a lever action is preferably exerted on the toggle lever 22 in the counterclockwise direction with the toggle lever abutment 58 as the fulcrum, which with sufficient leverage leads to an interruption and thus the opening of the contact tips 2 and 4. On the toggle levers 22, on each side of the third end surface 97, closer than the second end surface 56 but farther away than the third end surface from the toggle lever abutment 58, a fourth end surface 99 is preferably formed, which by interaction with the third stop surface 98 in a manner similar to that described above, is preferably used to break the welded contact tips 2 and 4 during the transition to the tripped position. On each toggle lever 22, there is preferably an inwardly-extending, pin-shaped limit stop 95, which in the event of contact tips 2 and 4 welded strongly together, comes into contact with the corresponding guide lug 66 on the bracing lever 20. Thus the mounting of the toggle lever 22 in the bracing lever 20 is also ensured.

One feature of the invention resides broadly in the breaker mechanism for a power circuit breaker in a die cast housing, connected with a crossbar 5 supporting contact arms 3, containing a connecting element 18, a bracing lever 20 which can be driven with it, two toggle levers 22 connected on their terminals ends, an energy storage mechanism engaged between the connecting element 18 and the ends of the toggle levers, a latch 26 which can be activated by trips, and a latch lever 28 which can be latched by the latch 26 and which for its part locks the bracing lever 20 in the untripped position, characterized by the following features: the breaker mechanism 10 can be inserted between two symmetrical breaker plates 14 mounted in the die cast housing, the toggle levers 22 are symmetrical to one another and are connected at a distance by means of a connecting shaft 12 which is engaged in cam slots 7 of the crossbar 5, the energy storage mechanism consists of only one toggle lever spring 24, one end of which is engaged with the connecting shaft 12, the toggle levers 22 are supported so that they can pivot against the force of the toggle lever spring 24 in the side walls 41 of the bracing lever 20, the bracing lever 20 is braced so that it can pivot against the force of the toggle lever spring 24 in the breaker plates 14, the latch 26 and the latch lever 28 can be inserted so that they pivot in the breaker plates 14, and are mounted in the breaker plates 14 by the force of a latch spring 30 engaged with the latch 26 and the latch lever 28.

Another feature of the invention resides broadly in the breaker mechanism, characterized by a pivot 44 providing support on each of the insides of the breaker plates 14, a correspondingly shaped open wrap-around 42 on the side walls 41 of the bracing lever 20.

Yet another feature of the invention resides broadly in the breaker mechanism, characterized by first end surfaces 54 formed on each of the toggle levers 22 for the open position, two end surfaces 56 for the closed position, and curved toggle lever abutments 58 located between these end surfaces 54, 56 and at some distance from them, first or second stop surfaces 62, 64 located in recesses in each of the side walls 41 of the bracing lever 20 corresponding to the first and second end surfaces 54, 56, as well as curved bracing lever abutments 80 located between these first and second stop surfaces 62, 64 and at some distance from them, an opening angle of the bracing lever abutments 60 which is greater than the toggle lever abutments 58, a flat intermediate position of the abutments 58, 60 in contact with one another between the contact points of the toggle lever spring 24 in the overextended position.

Still another feature of the invention resides broadly in the breaker mechanism, characterized by an inwardly-bent corner stop 46 on each of the breaker plates 14, on the side facing away from the latch lever 28, an extension 45 on the end surface of the side walls 41 of the bracing lever 20 which can be brought into contact with the above-mentioned corner stop 46 in the tripped position.

Yet still another feature of the invention resides broadly in the breaker mechanism, characterized by an inwardly-curving third stop surface 98 on each of the lateral arms 39 of the connecting piece 18, a correspondingly shaped third end surface 97 on the toggle levers 22, extending alongside and at a distance from the second end surface 56, whereby, during opening, after exceeding the overextended position of the toggle lever spring 24, the third stop surfaces 98 and the third end surfaces 97 can be made to interact to break the contact.

Still yet another feature of the invention resides broadly in the breaker mechanism, characterized by a fourth end surface 99 formed on the toggle levers 22, which is farther from the toggle lever abutment 58 than the third end surface 97, whereby, during tripping, the third stop surfaces 98 and the fourth end surfaces 99 can be made to interact to break the contact.

Another feature of the invention resides broadly in the breaker mechanism, characterized by on each of the side walls 41 of the bracing lever 20, inwardly curving guide lugs 66 for the toggle levers 22 near the bracing lever abutment 60.

Yet another feature of the invention resides broadly in the breaker mechanism, characterized by on each of the toggle levers 22, an inwardly-extending limit stop 95, which can be brought into contact with the corresponding guide lug 66.

Still another feature of the invention resides broadly in the breaker mechanism, characterized by a coil-shaped latch spring 30.

Still yet another feature of the invention resides broadly in the breaker mechanism, characterized by notch-shaped latch support recesses 70 in the breaker plates 14, corresponding lateral latch support moldings 68 on the latch 26.

Yet still another feature of the invention resides broadly in the breaker mechanism, characterized by an essentially triangular configuration of the latch support recesses 70, an essentially triangular prismatic configuration of the latch support moldings 72.

Another feature of the invention resides broadly in the breaker mechanism, characterized by notch-shaped latch lever support recesses 74 in the breaker plates 14, corresponding lateral latch lever support moldings 72 on the latch levers 28.

Yet another feature of the invention resides broadly in the breaker mechanism, characterized by an essentially triangular configuration of the latch lever support recesses 74.

Still another feature of the invention resides broadly in the breaker mechanism, characterized by a fastening of the latch spring 30 between a latch hole 77 and a latch lever hole 78.

Yet still another feature of the invention resides broadly in the breaker mechanism, characterized by a fastening of the latch spring 30 between a hook-shaped configuration of the latch 26 and of the latch lever 28.

Still another feature of the invention resides broadly in the breaker mechanism, characterized by a latch lever key 92 on the latch lever 22, a corresponding bearing surface 94-on the latch 26, whereby the latch lever key 92 and the bearing surface 94 can be made to interact to increase the prestress on the latch spring 30.

Examples of circuit breakers, and components found therein, which may be utilized in accordance with the embodiments of the present invention, may be found in the following U.S. Patents: U.S. Pat. No. 4,750,375 to Godesa, entitled "Drive Device for a Circuit Breaker with a Ratchet Wheel"; U.S. Pat. No. 4,678,873 to Preuss and Berndt, entitled "Low Voltage Circuit Breaker . . . "; U.S. Pat. No. 4,380,785 to Demayer and Claudin, entitled "Solid State Trip Unit . . . "; and U.S. Pat. No. 4,695,913 to Terracol and Roulet, entitled "Shunt Effect Low Voltage Circuit Breaker".

In summary, the present invention generally relates to a power circuit breaker with a breaker mechanism and a breaker mechanism for a power circuit breaker. The breaker mechanism for power circuit breakers is the energy storage link between the handle and the contact systems. Known breaker mechanisms are generally too expensive to manufacture. When contact welding occurs, there is also the risk that, in spite of the tripping of the breaker mechanism, the contact system will not open. The new breaker mechanism (10) reliably opens the contact system and consists of fewer and technologically simpler individual parts. It is inserted between two symmetrical breaker plates (14) held in a die cast housing, and in which a connecting piece (18) is mounted. Two toggle levers (22) are connected at a distance from one another by means of a connecting shaft (12) engaged in crossbar cam slots. A toggle lever spring (24) is engaged between the connecting piece (18) and the connecting shaft (12). A bracing lever (20) which can be driven by the connecting piece (18) is friction locked in the breaker plates (14), and the toggle levers (22) in the bracing lever (20). A latch lever (28) and a latch (26) holding the latter in the locked position are friction locked by means of a latch spring (30) in recesses (70, 74) of the breaker plates (14).

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. Power circuit breaker comprising:

a housing;

at least one electrical contact area disposed within said housing;

a breaker mechanism for connecting and disconnecting with said at least one electrical contact area, said breaker mechanism being disposed within said housing; said breaker mechanism comprising:

contact arm means being pivotably disposed within said housing, said contact arm means being configured for contacting the at least one electrical contact area to complete an electrical circuit;

toggle lever means being pivotably disposed within said housing, said toggle lever means comprising shaft said shaft means for connecting said toggle lever means with said contact arm means;

said contact arm means comprising cam slot means receiving said shaft means;

said shaft means and said cam slot means being configured for pivotally displacing said contact arm means in response to a pivotal displacement of said toggle lever means;

said toggle lever means comprising two toggle levers, said two toggle levers being disposed a substantial distance apart from one another along said shaft means, said two toggle levers being substantially symmetrical with respect to one another;

connecting element means being pivotably disposed within the housing;

single, unitary energy storage means being connected between said connecting element means and said means, said energy storage means being configured for providing a tensile force on said toggle lever means to pivot said toggle lever means in response to a pivotal displacement of said connecting element means; said energy storage means comprising only one spring;

bracing lever means being pivotably disposed within the housing, said bracing lever means for undergoing pivotal displacement in a plane of pivotal displacement;

said connecting element means being configured for pivotably displacing said bracing lever means in at least one rotational direction;

said bracing lever means comprising first and second side walls, each of said first and second side walls generally being disposed parallel to the plane of pivotal displacement of said bracing lever means;

each of said first and second side walls comprising a first surface and a second surface, said first surface of each of said first and second side walls facing inwardly and said second surface of each of said first and second side walls facing outwardly;

each of said first and second surfaces of each of said first and second side walls of said bracing lever means each defining a corresponding plane;

said first toggle lever being mounted for undergoing pivotal displacement within said first wall; and said second toggle lever being mounted for undergoing pivotal displacement within said second wall.

2. The circuit breaker according to claim 1, wherein:

said first toggle lever is mounted between said plane corresponding to said first surface of said first side wall and said plane corresponding to said second surface of said first side wall; and said second toggle lever is mounted between said plane corresponding to said first surface of said second side wall and said plane corresponding to said second surface of said second side wall.

3. The circuit breaker according to claim 2, further comprising:

breaker plate means being disposed within the housing;

said breaker plate means comprising a first breaker plate and a second breaker plate;

said first breaker plate and said second breaker plate being spaced apart from one another and being generally parallel to one another;

said first breaker plate and said second breaker plate being generally symmetrical with respect to one another.

4. The circuit breaker according to claim 3, wherein said breaker plate means comprises means for pivotably supporting each of said bracing lever means and said connecting element means generally between said first breaker plate and said second breaker plate.

5. The circuit breaker according to claim 4, wherein:

said bracing lever means is positionable between a first, retracted position and a second, forwardly displaced position;

said breaker mechanism further comprises a latching arrangement for locking said bracing lever means into said first, retracted position;

said latching arrangement comprises latch means and latch lever means;

each of said latch means and said latch lever means extends generally between, and is pivotably mounted generally between, said first breaker plate and said second breaker plate;

said latching arrangement being configured for releasing said bracing lever means in response to a tripping stimulus;

said bracing lever means being configured for being pivotally displaced from said first, retracted position to said second, forwardly disposed position in response to the releasing of said bracing lever means from said latching arrangement and under the influence of said spring.

6. The circuit breaker according to claim 5, wherein:

said means for pivotably mounting said bracing lever means comprises a protrusion disposed on each of said first breaker plate and said second breaker plate;

said bracing lever means comprises a first extension and a second extension, said first extension being disposed adjacent said first breaker plate and said second extension being disposed adjacent said second breaker plate;

each of said first extension and said second extension comprising a wrap-around portion;

each said wrap-around portion being configured to wrap around a significant portion of a corresponding one of said protrusions to provide a fulcrum for the pivotal displacement of said bearing lever means.

7. The circuit breaker according to claim 6, wherein:

each of said toggle levers is positionable between a first, retracted position and a second, forwardly disposed position;

said bracing lever means comprises a first recess and a second recess; and each of said toggle levers is mounted for pivotal displacement within a corresponding one of said recesses.

8. The circuit breaker according to claim 7, wherein:

each of said first and second recesses comprises a first contact surface and a second contact surface;

each of said toggle levers comprises a first contact surface and a second contact surface;

said first contact surface of each said toggle lever is configured for contacting said first contact surface of each said recess when said toggle levers are in said first position;

said second contact surface of each said toggle lever is configured for contacting said second contact surface of each said recess when said toggle levers are in said second position;

each said toggle lever comprises an abutment;

said abutment of each said toggle lever defines a first angle;

said first and second contact surfaces of each said recess define a second angle; and said second angle is greater than said first angle.

9. The circuit breaker according to claim 8, wherein:

each said recess comprises an intermediate contact surface joining said first contact surface and said second contact surface of said recess; and each said abutment of each said toggle lever is configured for contacting said intermediate contact surface of each said recess to ensure pivotal movement of said toggle levers.

10. The circuit breaker according to claim 9, wherein:

each said abutment and each said intermediate contact surface is generally curved; and each said abutment is configured for undergoing a rocking motion along each said intermediate contact surface when said toggle levers are being displaced between said first position and said second position of said toggle levers, to provide pivotal movement of said toggle levers.

11. The circuit breaker according to claim 10, wherein:

each said abutment comprises a generally flat central portion;

each said intermediate contact surface comprises a generally flat central portion; and said generally flat central portion of each said abutment being configured for interfacing with said generally flat central portion of each said recess.

12. The circuit breaker according to claim 11, wherein:

said spring is connected to said connecting element means at a first locus of connection and to said shaft at a second locus of connection;

said generally flat central portion of each said abutment is configured to contact said generally flat central portion of each said intermediate contact surface of each said recess when:

said toggle levers are being displaced between said first position and said second position; and a plane defined through said first and second loci of connection of said spring intersects said generally flat central portion of each said abutment and said generally flat central portion of each said intermediate contact surface of each said recess.

13. The circuit breaker according to claim 12, wherein said latching arrangement further comprises latch spring means connected between said latch means and said latch lever means.

14. The circuit breaker according to claim 13, wherein:

each of said first breaker plate and said second breaker plate comprises stop means;

said stop means comprising a bent extension of each of said first breaker plate and said second breaker plate;

each of said side walls of said bracing lever means comprises a forward extension, each said forward extension having a generally flat surface;

said bent extension of each of said first breaker plate and said second breaker plate being configured for contacting one another to arrest said bracing lever means in said second, forwardly displaced position.

15. The circuit breaker according to claim 14, wherein:

said connecting element means comprising a pair of lateral arms;

said lateral arms are disposed generally parallel to said first breaker plate and said second breaker plate;

said connecting element means comprises stop surface means;

said stop surface means comprising an inwardly curved projection disposed on each of said first and second lateral arms;

each of said toggle levers comprises a recessed portion disposed adjacent said second contact surface; and said recessed portion of each of said toggle levers being configured for accommodating a corresponding one of said inwardly curved projections therewithin;

said recessed portion of each of said toggle levers and said inwardly curved projections being configured to transfer a maximal force from said connecting element means to said toggle levers, and thence to said contact arm means, during pivotal movement of said connecting means from said second position to said first position.

16. The circuit breaker according to claim 15, wherein:

each of said toggle levers comprises an additional contact surface;

said additional contact surface being disposed adjacent said second contact surface; and each said additional contact surface being configured for contacting a corresponding one of said inwardly curved projections of said connecting element means during tripping of said circuit breaker to assist in breaking the contact between said contact arm means and said at least one electrical contact area.

17. The circuit breaker according to claim 16, wherein said bracing lever means comprises lug means extending from each of said side walls, said lug means being configured for laterally guiding each of said toggle levers.

18. The circuit breaker according to claim 17, further comprising:

said lug means comprising a pair of lugs, each lug of said pair of lugs extending from a corresponding one of said side walls of said bracing lever means;

each of said toggle levers comprising limit stop means;

each said limit stop means comprising an inward protrusion disposed on each of said toggle levers;

each of said limit stop means being configured for being brought into contact with a corresponding one of said lug means;

said latch spring means consisting of a singular coil-shaped spring;

each of said first breaker plate and said second breaker plate comprising a notch-shaped latch support recess;

said latch means comprising a pair of latch support moldings, each of said pair of latch support moldings being pivotably accommodated in a corresponding one of said notch-shaped latch support recesses;

each of said latch support recesses having a generally triangular configuration;

each of said latch support moldings having a generally triangular prismatic configuration;

each of said first breaker plate and said second breaker plate comprising a notch-shaped latch lever support recess;

said latch lever means comprising a pair of latch lever support moldings, each of said latch lever support moldings being pivotably accommodated in a corresponding one of said notch-shaped latch lever support recesses;

each of said latch lever support recesses having a generally triangular configuration;

each of said latch lever support moldings having a generally triangular prismatic configuration;

said coil-shaped spring comprising:

a first end and a second end; and a first attachment portion at said first end and a second attachment portion at said second end;

said latch means comprising a hole for accommodating said first attachment portion of said coil-shaped spring;

said latch lever means comprising a hole for accommodating said second attachment portion of said coil-shaped spring;

each of said first and second attachment portions of said coil-shaped spring comprising hook means for hooking, respectively, into said hole of said latch means and said hole of said latch lever means;

each of said latch means and said latch lever means comprising a flange portion;

said hole of said latch means being disposed in said flange portion of said latch means;

said hole of said latch lever means being disposed in said flange of said latch lever means;

said latch lever means comprising a bent extension;

said latch means comprising a bearing surface;

said latch arrangement being configured such that said latch spring means has a prestress applied thereto;

said bent extension and said bearing surface being configured to interact to increase the prestress on said latch spring;

said housing has a bottom; and each of said first and second breaker plates comprises flange means, each said flange means being attached to said bottom of said housing.

* * * * *

UNITED STATES PATENT AND TRADEMARK OFFICE

CERTIFICATE OF CORRECTION

PATENT NO. : 5,369,384
DATED : November 29, 1994
INVENTOR(S) : Volker HEINS

It is certified that error appears in the above-indentified patent and that said Letters Patent is hereby corrected as shown below:

In column 9, line 54, after 'surface' delete "94-on" and insert --94 on--.

In column 10, line 63, Claim 1, after the first occurence of "shaft" insert --means,--.

In column 11, line 12, Claim 1, before the first occurence of "means" insert --toggle lever--.

Signed and Sealed this

Third Day of September, 1996

*Attest:*

Bruce Lehman

BRUCE LEHMAN

*Attesting Officer*

*Commissioner of Patents and Trademarks*